US011877615B2

(12) United States Patent
Kim et al.

(10) Patent No.: US 11,877,615 B2
(45) Date of Patent: Jan. 23, 2024

(54) WIG APPARATUS

(71) Applicant: SHAKE-N-GO FASHION, INC., Port Washington, NY (US)

(72) Inventors: Susan Kim, Manhasset, NY (US); Jason Kim, Manhasset, NY (US)

(73) Assignee: SHAKE-N-GO FASHION, INC., Port Washington, NY (US)

( * ) Notice: Subject to any disclaimer, the term of this patent is extended or adjusted under 35 U.S.C. 154(b) by 45 days.

(21) Appl. No.: 17/124,902

(22) Filed: Dec. 17, 2020

(65) Prior Publication Data

US 2021/0177079 A1 Jun. 17, 2021

Related U.S. Application Data

(60) Provisional application No. 62/948,907, filed on Dec. 17, 2019.

(51) Int. Cl.
*A41G 3/00* (2006.01)

(52) U.S. Cl.
CPC ..... *A41G 3/005* (2013.01); *A41G 3/0016* (2013.01)

(58) Field of Classification Search
CPC ..... A41G 3/00; A41G 3/0008; A41G 3/005; A41G 3/0016; A41G 3/0033; A41G 3/0041; A41G 3/0058; A41G 3/0066; A41G 3/0075; A41G 5/00; A41G 5/004; A41G 5/0006; A41G 5/0046; A41G 5/0053; A41G 5/0073
See application file for complete search history.

(56) References Cited

U.S. PATENT DOCUMENTS

| | | | | |
|---|---|---|---|---|
| 3,521,648 | A * | 7/1970 | Capparelli | A41G 3/0016 132/53 |
| D518,604 | S | 4/2006 | Belo | |
| 7,537,014 | B1 * | 5/2009 | Yoo | A41G 3/0058 132/201 |
| 9,027,568 | B2 | 5/2015 | Lee | |
| 9,107,460 | B1 * | 8/2015 | Synn | A41G 3/0016 |
| 2001/0013351 | A1 * | 8/2001 | Tang | A41G 3/0033 132/201 |
| 2004/0139978 | A1 * | 7/2004 | Anzivino | A41G 3/0041 132/54 |

(Continued)

FOREIGN PATENT DOCUMENTS

| | | | |
|---|---|---|---|
| JP | 05-295605 | A | 11/1993 |
| KR | 10-1647616 | B1 | 8/2016 |
| KR | 20190143641 | A | 12/2019 |

*Primary Examiner* — Cris L. Rodriguez
*Assistant Examiner* — Karim Asqiriba
(74) *Attorney, Agent, or Firm* — Cowan, Liebowitz & Latman, P.C.; Mark Montague; Brian R. Volk

(57) ABSTRACT

A wig apparatus is provided. The wig apparatus includes: a mesh base comprising an inner surface, an outer surface, a fold portion and a terminal edge portion; a band member comprising a first surface, a second surface, a top edge and a bottom edge, wherein the first surface is coupled to the inner surface of the mesh base and wherein the second surface is coupled to the inner surface of the mesh base; a first portion of artificial hair coupled to at least the outer surface of the mesh base adjacent to the first surface; and a second portion of artificial hair coupled to the outer surface of the mesh base adjacent to the second surface.

13 Claims, 5 Drawing Sheets

(56) References Cited

U.S. PATENT DOCUMENTS

| | | | | |
|---|---|---|---|---|
| 2006/0260627 | A1* | 11/2006 | Park | A41G 3/00 132/54 |
| 2013/0098380 | A1* | 4/2013 | Kim | A41G 5/006 132/53 |
| 2014/0116456 | A1 | 5/2014 | Palmer-Rogers | |
| 2014/0251362 | A1* | 9/2014 | Lee | A41G 3/00 132/54 |
| 2015/0327609 | A1* | 11/2015 | Suh | A41G 3/0075 132/54 |
| 2017/0079355 | A1 | 3/2017 | Kim et al. | |
| 2017/0095026 | A1* | 4/2017 | Chung | A41G 3/0041 |
| 2018/0007988 | A1 | 1/2018 | Kim et al. | |
| 2018/0116321 | A1* | 5/2018 | Kim | A41G 3/0075 |
| 2019/0261714 | A1 | 8/2019 | Kim et al. | |
| 2019/0297977 | A1 | 10/2019 | Kim et al. | |

* cited by examiner

WIG APPARATUS

REFERENCE TO RELATED APPLICATIONS

This application claims priority to U.S. Provisional Application No. 62/948,907 filed on Dec. 17, 2019, the entire contents of which are incorporated herein by reference.

BACKGROUND OF THE INVENTION

1. Field of the Invention

The present invention relates generally to wigs, and more particularly, to a wig apparatus including artificial hair.

2. Description of the Related Art

Wigs are used by people to enhance their appearance and to conceal their natural hair. Wigs generally include multiple strands of hair attached to a cap to form a unit that can be secured to a user's scalp. Hair weaves and hair extensions are also used by people to either conceal or supplement their natural hair. In some cases, people use wigs when they are experiencing baldness or thinning of their natural hair. For those experiencing baldness or thinning of natural hair, use of wigs provides an alternative to use of potentially dangerous hair growth drugs or chemicals, or uncomfortable hair plugs. In other cases, people use wigs for temporary purposes when they are undergoing medical treatments that result in loss of their hair, such as chemotherapy.

Certain wigs are designed to only partially cover a user's head. These partial wigs, often referred to in the industry as a "closure cap," includes artificial hair that is attached to a mesh base. The mesh base is attached to the user's head with a clip, comb, or other fastener. The partial wig tends to shift and/or wrinkle on the user's head when worn for extended periods of time, and thus, requires frequent attention to maintain a desirable and fashionable appearance.

SUMMARY OF THE INVENTION

According to embodiments of the present invention, a wig apparatus is provided. The wig apparatus includes: a mesh base comprising an inner surface, an outer surface, a fold portion and a terminal edge portion; a band member comprising a first surface, a second surface, a top edge and a bottom edge, wherein the first surface is coupled to the inner surface of the mesh base and wherein the second surface is coupled to the inner surface of the mesh base; a first portion of artificial hair coupled to at least the outer surface of the mesh base adjacent to the first surface; and a second portion of artificial hair coupled to the outer surface of the mesh base adjacent to the second surface.

According to further embodiments: the first surface faces a direction opposite to the second surface; at least a portion of the first portion of artificial hair is coupled to the outer surface of the mesh base at a position substantially equidistant to the fold portion as at least a portion of the second portion of artificial hair is coupled to the outer surface of the mesh base; the bottom edge is disposed adjacent to the fold portion; the top edge is disposed adjacent to the terminal edge portion; the mesh base is configured to wrap around the band member extending across at least a portion of the second surface of the band member; the mesh base extends across an entire surface of the first surface and at least a portion of the second surface of the band member with a least a portion of the second surface of the band member not in contact with the mesh base; the mesh base extends across an entire surface of the first surface and extends across an entire surface of the second surface of the band member; a strip member is coupled to the second surface of the band member; at least a portion of the strip member is disposed between the second surface of the band member and the inner surface of the mesh base; at least a portion of the mesh base is disposed between the strip member and the second surface of the band member; the terminal edge portion is disposed between the second surface of the band member and the strip member; and the strip member does not extend across an entire surface of the second surface.

According to an additional embodiment, a wig apparatus is provided. The wig apparatus includes: a mesh base comprising an inner surface, an outer surface, a fold portion and a terminal edge portion; a band member comprising a first band end, a second band end, a first surface, a second surface, a top edge and a bottom edge, wherein the first surface is coupled to the inner surface of the mesh base and wherein the second surface is coupled to the inner surface of the mesh base; a first portion of artificial hair coupled to at least the outer surface of the mesh base adjacent to the first surface; a second portion of artificial hair coupled to the outer surface of the mesh base adjacent to the second surface; and a hair parting region extending from the fold portion to substantially a center of the mesh base.

According to further embodiments: a strip member comprises a first strip end and a second strip end, wherein the strip member is coupled to the second surface of the band member, and wherein the first strip end is coupled to the first band end and the second strip end is coupled to the second band end; the band member does not extend around an entire circumference of the wig apparatus and wherein the strip member does not extend around an entire circumference of the wig apparatus; the hair parting region is at least partially disposed between the first strip end and the second strip end; the mesh base extends across an entire surface of the first surface and at least a portion of the second surface of the band member with a least a portion of the second surface of the band member not in contact with the mesh base; the first surface faces a direction opposite to the second surface; and at least a portion of the first portion of artificial hair is coupled to the outer surface of the mesh base at a position substantially equidistant to the fold portion as at least a portion of the second portion of artificial hair is coupled to the outer surface of the mesh base.

BRIEF DESCRIPTION OF THE DRAWINGS

The above and other aspects, features and advantages of certain embodiments will be more apparent from the following detailed description taken in conjunction with the accompanying drawings, in which.

DETAILED DESCRIPTION OF THE PRESENT INVENTION

Figure 1:
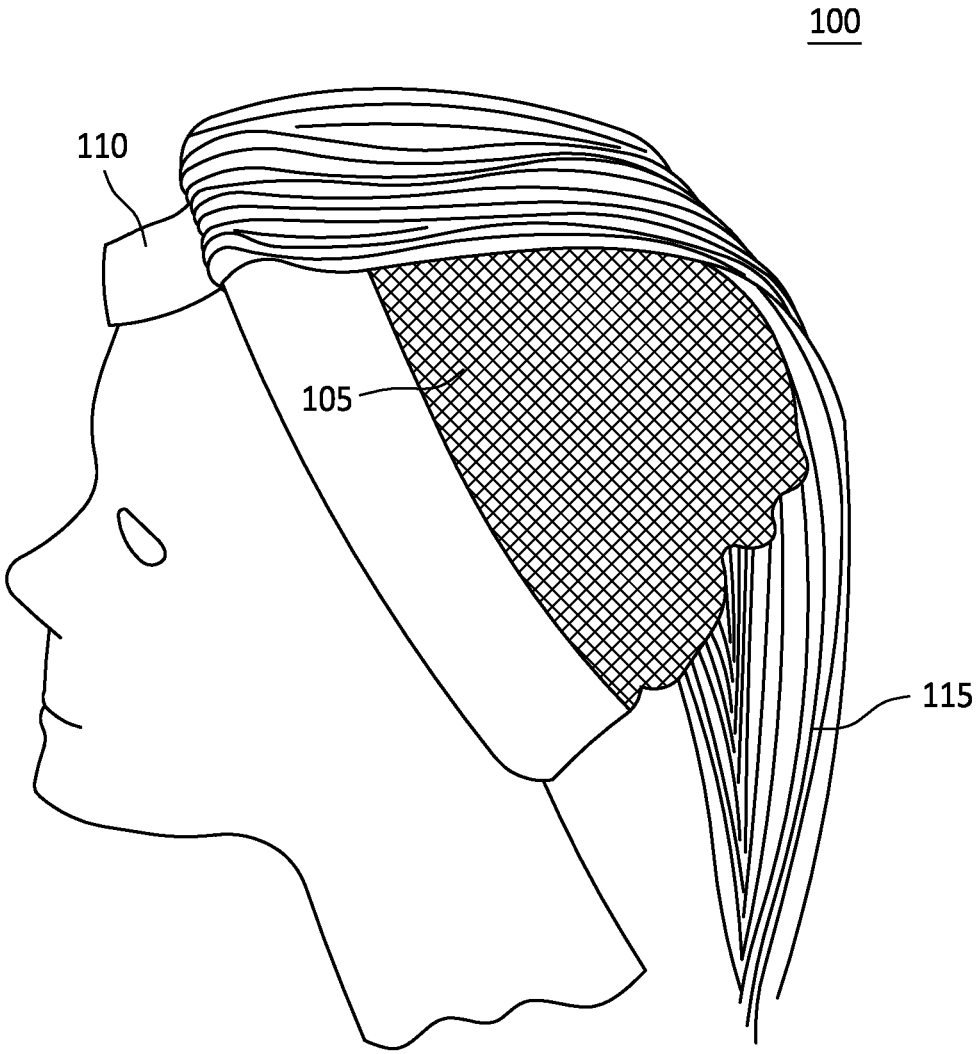
FIG. 1 illustrates a wig apparatus, according to an embodiment of the present invention.

The following detailed description of certain embodiments will be made in reference to the accompanying drawings. In the detailed description, explanation about related functions or constructions known in the art are omitted for the sake of clearness in understanding the concept of the invention, to avoid obscuring the invention with unnecessary detail.

The phrase "artificial hair," as used herein, refers to synthetic hair products as well as human hair or animal hair and combinations thereof. The artificial hair may be embodied in various traditional hair colors, such as black, brown, blonde, and red, as well as non-traditional hair colors, such as blue, green, and purple, and combinations thereof, including individual strands of hair having two or more colors. The artificial hair may be configured in various textures, including curly, wavy, straight, etc. The artificial hair may be configured in various lengths and thicknesses.

The term "user," as used herein, refers to any purchaser of the wig configured according to any of the embodiments disclosed herein, including, but not limited to, individual members of the public, wholesale distributors, retail merchants, manufacturers, importers and exporters of the wig and related components of the wig.

Reference to individual embodiments, whether by number of embodiment or relevant feature of the embodiment, is used for convenience in describing such embodiments. Moreover, reference to individual embodiments does not indicate that any of such embodiments are preferred over any other embodiments. Furthermore, each individual embodiment may be combined with any other individual embodiment whether or not expressly stated.

Embodiments of the invention described herein provide a wig apparatus that includes a mesh base and a hair coupling region. The hair coupling region includes artificial hair coupled to the outer surface thereof. The mesh base is configured to wrap around the user's head and secure the wig apparatus to the user's head. The hair coupling region is disposed in the front portion of the wig apparatus, i.e., adjacent to the user's forehead when the wig apparatus is worn by the user. The mesh base holds the hair coupling region flat and prevents the hair coupling region from wrinkling when the wig apparatus is worn by the user. The wig apparatus provides the user with a useful and convenient product for partially covering their natural hair with artificial hair.

Embodiments of the invention described herein also provide a wig apparatus that includes a mesh base and a hair parting region. In this configuration, wefts of artificial hair are sewn, knotted or crocheted to the mesh base. Individual strands of hair are coupled to the hair parting region to provide the user with a natural-appearing part. The user is therefore able to customize the location, density, style and color of the wefts of artificial hair on the wig apparatus. The mesh base wraps around a headband of the wig apparatus such that wefts of artificial hair can be coupled to the outer surface and edge of the wig apparatus as well as the interior portion of the headband, thus providing a natural and desirable appearance.

According to a further embodiment of the invention, a wig apparatus is provided including a mesh base that at least partially wraps around a band member. Separate portions of artificial hair may be coupled by the user to the mesh base on the inner area of the wig apparatus and the outer area of the wig apparatus in the vicinity of the band member. The wig apparatus allows the user to customize the placement of artificial hair to their desired appearance.

FIG. 1 illustrates a wig apparatus 100, according to an embodiment of the present invention. The wig apparatus 100 includes a mesh base 105, a hair coupling region 110, and artificial hair 115. It is noted that in certain embodiments, human hair can be used instead of artificial hair 115. The artificial hair 115 can be curly, straight, or other suitable texture, and combinations thereof.

The hair coupling region 110 includes an inner surface and an outer surface. The inner surface of the hair coupling region 110 refers to the side that faces towards the user's head when the wig apparatus 100 is worn. The outer surface of the hair coupling region 110 refers to the side that faces away from the user's head when the wig apparatus 100 is worn. The artificial hair 115 is coupled to the outer surface of the hair coupling region 110. In certain embodiments, the artificial hair 115 may be sewn, glued, stitched, hand-tied and knotted, or other suitable method of attachment, to the hair coupling region 110. The artificial hair 115 may be coupled to the hair coupling region 110 in individual strands or in bundles, e.g., wefts, of individual strands. The hair coupling region 110 may be sewn, glued, or other suitable method of attachment, to the mesh base 105. The hair coupling region 110 is disposed in the front portion of the wig apparatus 100, i.e., adjacent to the user's forehead when the wig apparatus 100 is worn by the user. The hair coupling region 110 is constructed of a fine nylon mesh, though other suitable materials may be used.

Figure 2:
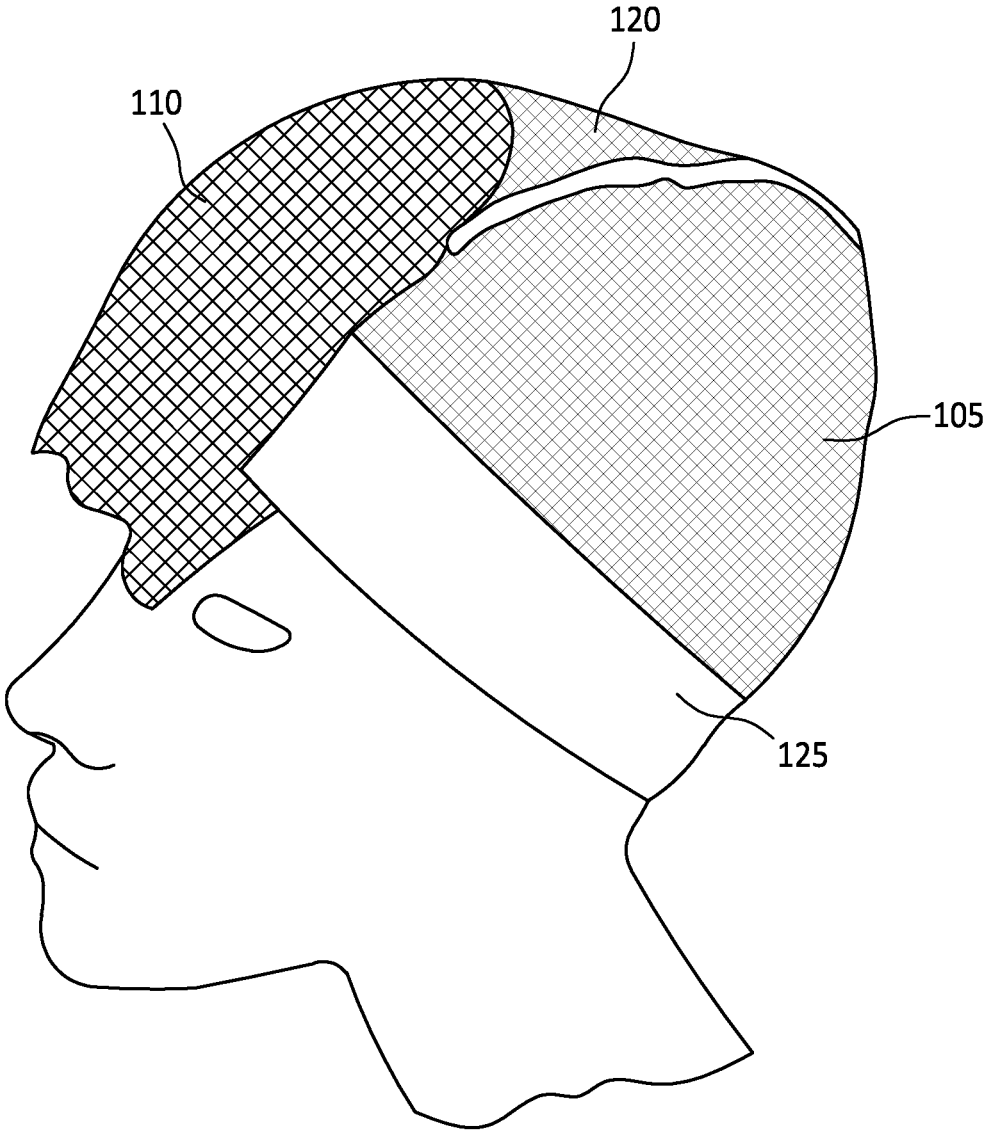
FIG. 2 illustrates the wig apparatus of FIG. 1 in an inside-out configuration, for purposes of illustration.

FIG. 2 illustrates the wig apparatus 100 with the artificial hair 115. The wig apparatus 100 is shown in an inside-out configuration for purposes of illustration. The mesh base 105 includes an inner surface and an outer surface. The inner surface of the mesh base 105 refers to the side that faces towards the user's head when the wig apparatus 100 is worn. The outer surface of the mesh base 105 refers to the side that faces away from the user's head when the wig apparatus 100 is worn. The mesh base 105 is constructed of nylon, cotton, or other suitable material and may be elastic or inelastic. For example, the mesh base 105 may be stocking or net material. The mesh base 105 includes a seam 120.

In certain embodiments, separate sections of the mesh base 105 are stitched together at the seam 120. In certain embodiments, the mesh base 105 is constructed of one piece of material in which no seams are present.

The mesh base 105 includes a head band 125. The head band 125 is constructed of an elastic material. The head band 125 includes a first end and a second end that connect on opposite sides of the hair coupling region 110. In other words, the head band 125 does not extend around the entire circumference of the wig apparatus 100—the hair coupling region 110 completes the portion of the remaining circumference left incomplete by the head band 125. The head band 125 secures the wig apparatus 100 to the user's head.

The hair coupling region 110 is illustrated as being in a U-shape in FIG. 2. In certain embodiments, the hair coupling region 110 can be any suitable shape, including oval, circle, rectangle, square, etc. Furthermore, the hair coupling region 110 may be 1-6 inches long and 1-6 inches wide, including combinations thereof. That is, the hair coupling region 110 may be any one of less than 1, 1, 2, 3, 4, 5, or 6 inches long and any one of 1, 2, 3, 4, 5, or 6 inches wide. In certain embodiments, the hair coupling region 110 extends around the entire circumference of the wig apparatus 100.

Figure 3:
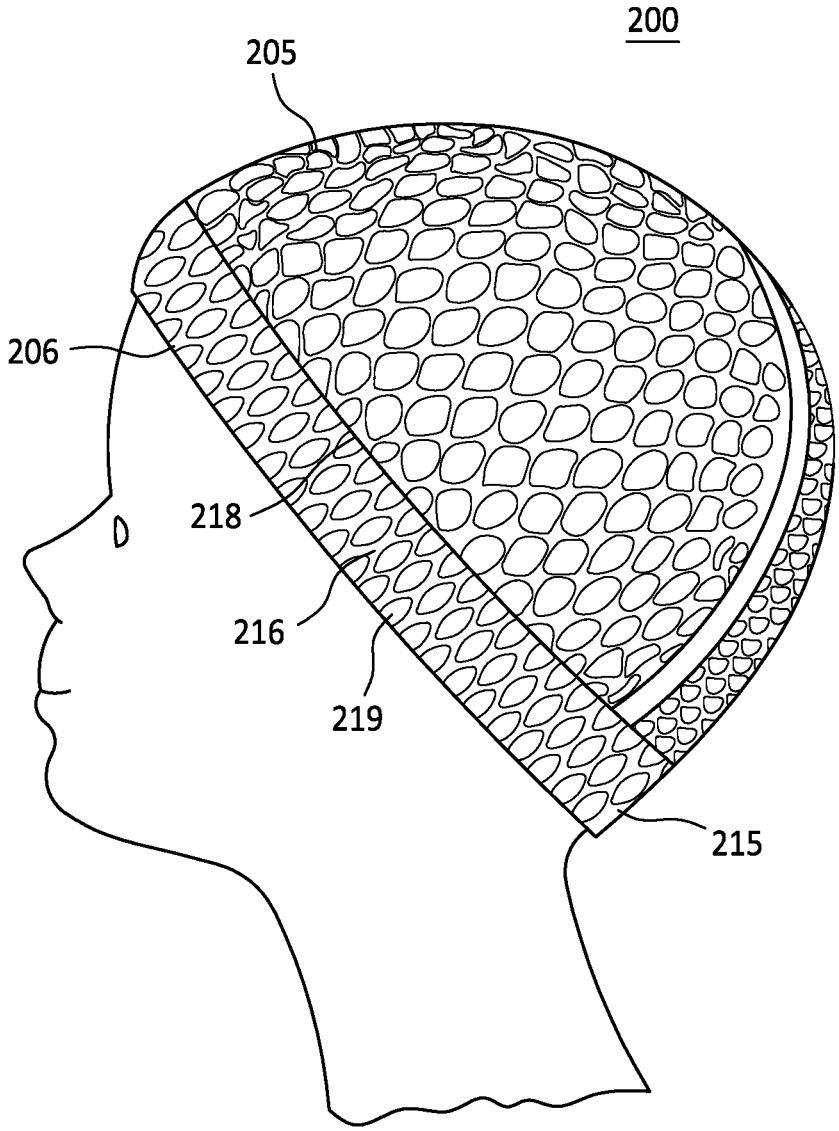
FIGS. 3 illustrates a side view of a wig apparatus, according to an alternative embodiment.
Figure 4:
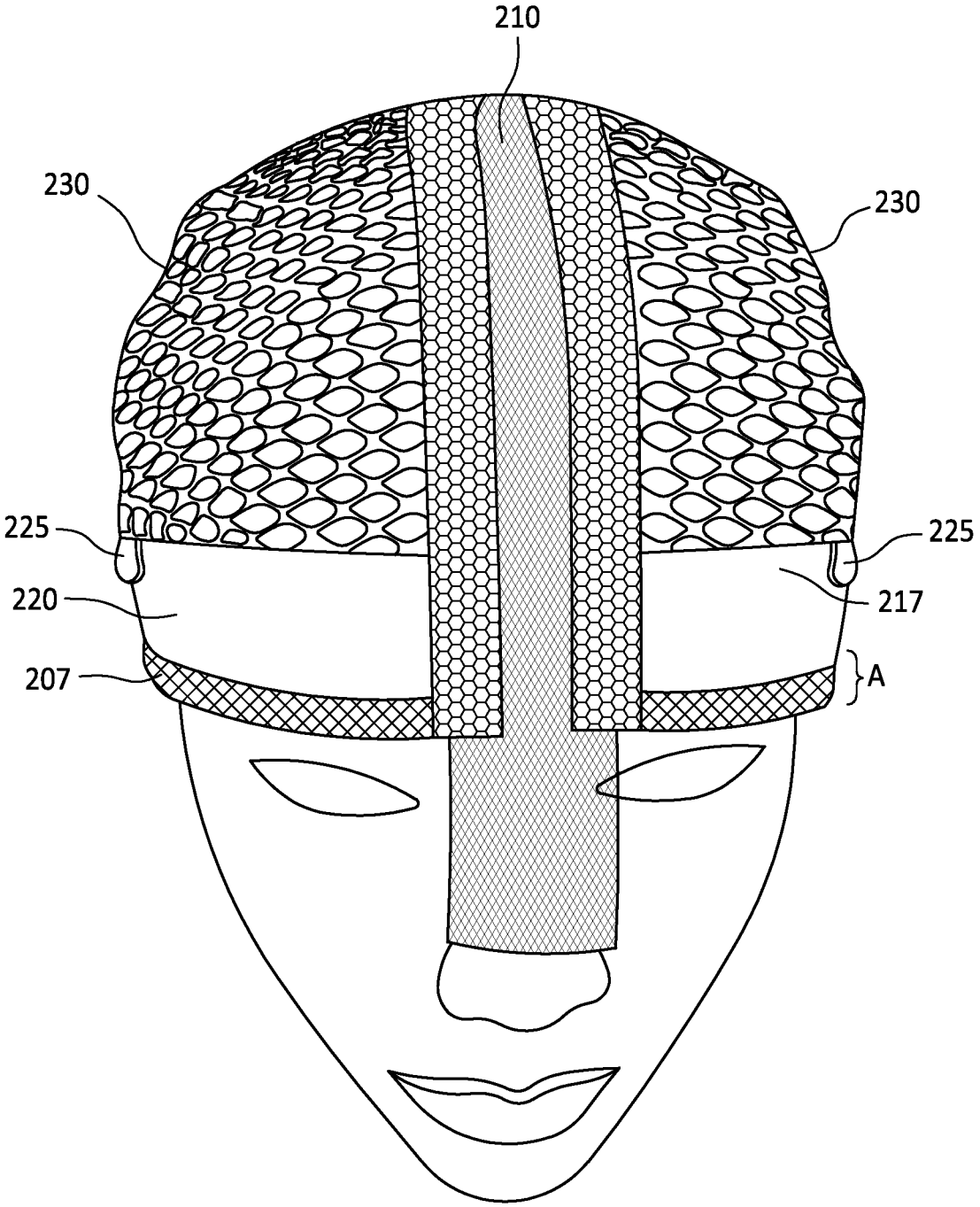
FIGS. 4 and 5 illustrates a front view and a rear view, respectively of the wig apparatus shown in FIG. 3.

FIGS. 3 and 4 illustrate a side view and a front view, respectively, of a wig apparatus 200 according to an alternative embodiment. The wig apparatus 200 includes a mesh base 205, a fold portion 206, a terminal edge portion 207, a hair parting region 210, a band member 215, a strip member 220 and a comb 225. The wig apparatus 200 is illustrated in an inside-out configuration in FIGS. 3 and 4 for the purpose of showing the internal features thereof.

The mesh base 205 includes an inner surface and an outer surface. The inner surface of the mesh base 205 refers to the side that substantially faces towards the user's head when the wig apparatus 200 is worn, with the exception of the portion of the mesh base 205 that extends from the fold portion 206 to the terminal edge portion 207, which faces in the opposite direction since this portion has been folded around the band member 215. The outer surface of the mesh base 205 refers to the side that substantially faces away from the user's head when the wig apparatus 200 is worn, with the exception of the portion of the mesh base 205 that extends from the fold portion 206 to the terminal edge portion 207, which faces in the opposite direction since this portion has been folded around the band member 215. The mesh base 205 is constructed of nylon, cotton, or other suitable material and may be elastic or inelastic. For example, the mesh base 205 may be stocking or net material. Individual strands or wefts of artificial hair (not shown) are sewn or crocheted to the surface of the mesh base 205. "Wefts" of artificial hair refer to bundles of multiple strands of artificial hair. The user can therefore customize the location, density, style and color of the wefts of artificial hair on the wig apparatus 200.

The hair parting region 210 is configured to have individual strands of artificial hair coupled to an outer surface thereof. The hair parting region 210 mimics the appearance of the user's skin when the artificial hair is parted. The hair parting region 210 is constructed of a fine mesh of a suitable material, such as nylon, cotton, and combinations thereof. Such materials are referred to as mesh fabric and/or crochet net in the wig industry. The hair parting region 210 can be embodied in different colors that correspond to the color of the user's scalp. The width and shape of the hair parting region 210 can vary according to particular applications.

The mesh of the hair parting region 210 is coupled to the mesh base 205 by hand stitching, machine stitching, glue, or other suitable method of attachment and combinations thereof. In the embodiment shown in FIG. 4, the hair parting region 210 is disposed in the center of the mesh base 205. In certain embodiments, the hair parting region 210 is disposed on the left-side or the right-side of the mesh base 210. The hair parting region 210 extends from the edge, i.e., the fold portion 206, of the mesh base 205 to approximately the center of the mesh base 205. The hair parting region 210 is substantially perpendicular to the edge of the mesh base 205. In certain embodiments, the angle at which the hair parting region 210 extends away from the edge of the mesh base can vary to either extend from the center to the left-side or extend from the center to the right-side. Additionally, the hair parting region 210 is illustrated as being straight, however, in certain embodiments, the hair parting region 210 is curved.

The band member 215 is disposed along the edge of the mesh base 205. The band member includes a first exterior surface 216, a second interior surface 217, a top edge 218 and a bottom edge 219. The mesh base 205 wraps around the interior surface 217 of the band member 215 such that the exterior surface 216 is coupled to the inner surface of the mesh base 205 and the interior surface 217 is coupled to the inner surface of the mesh base 205. The band member 215 includes a first end and a second end that connect to opposite sides of the hair parting region 210. In other words, the band member 215 does not extend around the entire circumference of the wig apparatus 200—the hair parting region 210 completes the portion of the remaining circumference left incomplete by the band member 215. The band member 215 is constructed of an elastic material, such as nylon, or other suitable material, and is configured to secure the wig apparatus 200 to the user's head.

The bottom edge 219 of the band member 215 is disposed adjacent to the fold portion 206 of the mesh base 205. In certain embodiments, the bottom edge 219 of the band member 215 is in contact with the fold portion 206. The top edge 219 of the band member 215 is disposed adjacent to the terminal edge portion 207 of the mesh base 205. In certain embodiments, the top edge 219 of the band member 215 is in contact with the terminal edge portion 207 of the mesh base 205.

In certain embodiments, the terminal edge portion 207 of the mesh base extends to various points along the interior surface 217. That is, in certain embodiments the mesh base 205 extends across an entire surface of the exterior surface 216 and at least a portion of the interior surface 217 of the band member 215 with a least a portion of the interior surface 217 of the band member 215 not in contact with the mesh base 205. In certain embodiments, the mesh base 205 extends across an entire surface of the exterior surface 216 and an entire surface of the interior surface 217 of the band member 215.

It is noted that at any given point on the band member 215, the exterior surface 216 and the interior surface 217 face in opposite directions.

The strip member 220 is coupled to the interior surface 217 of the band member 215. The strip member 220 is coupled to the band member 215 by any suitable method, including glue, hand sewing, machine sewing, and combinations thereof. The strip member 220 is constructed of silicone, rubber, or other suitable material. The strip member 220 includes a first strip end and a second strip end that are disposed at a position corresponding to the first end and the second end of the band member 215. In certain embodiments, the first strip end is coupled to the first end of the band member 215 and the second strip end is coupled to the second end of the band member 215. The strip member 220 does not extend around the entire circumference of the wig apparatus 200—the hair parting region 210 completes the portion of the remaining circumference left incomplete by the band member 215 and the strip member 220. Thus, in certain embodiments, the hair parting region 210 is at least partially disposed between the first strip end and the second strip end. The strip member 220 is configured to create friction between the wig apparatus 200 and the user's scalp and/or the user's natural hair in order to prevent the wig apparatus 200 from slipping or shifting on the user's head.

It is noted that the strip member 220 is not a required component of the wig apparatus 200. In other words, in certain embodiments, the strip member 220 is not present.

As illustrated in FIG. 4, the strip member 220 covers a portion of the interior surface of the band member 215, but not the entire interior surface of the band member 215. The area of the interior surface of band member 215 not covered by the strip member 220, denoted by bracket "A" in FIG. 4, leaves the portion of the mesh base 205 that is wrapped around the band member 215 visible and accessible to the user. The user is therefore able to attach additional wefts of artificial hair to the edge of the band member 215 and to the mesh base 205 in the portion not covered by the strip member 220. Thus, in certain embodiments, separate wefts of artificial hair may be coupled to the mesh base 205 on the band member 215 at corresponding points of the exterior and interior of the band member 215. In other words, at a given point on the band member 215, artificial hair, whether as wefts or individual strands, can be coupled to the mesh base 205 on the band member 215 such that the location of coupling the artificial hair overlaps at corresponding points on the exterior and interior of the band member 215. In certain embodiments, artificial hair is coupled to the mesh base on the interior and exterior of the band member 215 at substantially equal distances from the edge of the band member 215 and at substantially equal distances from the fold portion 206 of the mesh base 205.

In certain embodiments, the strip member 220 covers a portion of the mesh base 205 that is disposed on the interior of the band member 215. In certain embodiments, the mesh base 205 extends across a portion of the strip member 220. In other words, the strip member 220 may be applied over the mesh base 205 or under the mesh base 205. In certain embodiments, the mesh base 205 wraps around the band member 215 such that the mesh base 205 extends across less than half of the height of the strip member 220. In certain embodiments, the mesh base 205 wraps around the band member 215 such that the mesh base 205 extends across at least half of the height of the strip member 220. In certain embodiments, the mesh base 205 wraps around the band member 215 such that the mesh base 205 extends across less than a quarter of the height of the strip member 220. In certain embodiments, the mesh base 205 wraps around the band member 215 such that the mesh base 205 extends across at least a quarter of the height of the strip member 220. In certain embodiments, the strip member 220 does not extend across an entire surface of the interior surface 217.

In certain embodiments, at least a portion of the strip member 220 is disposed between the second surface of the band member 215 and the inner surface of the mesh base 205. In certain embodiments, at least a portion of the mesh base 205 is disposed between the strip member 220 and the second surface of the band member 215. In certain embodiments, the terminal edge portion 207 is disposed between the interior surface 217 of the band member 215 and the strip member 220.

It is noted that the strip member 220 illustrated in FIG. 4 can also be applied to the embodiments shown in FIGS. 1, 2, 3 and 5.

Figure 5:
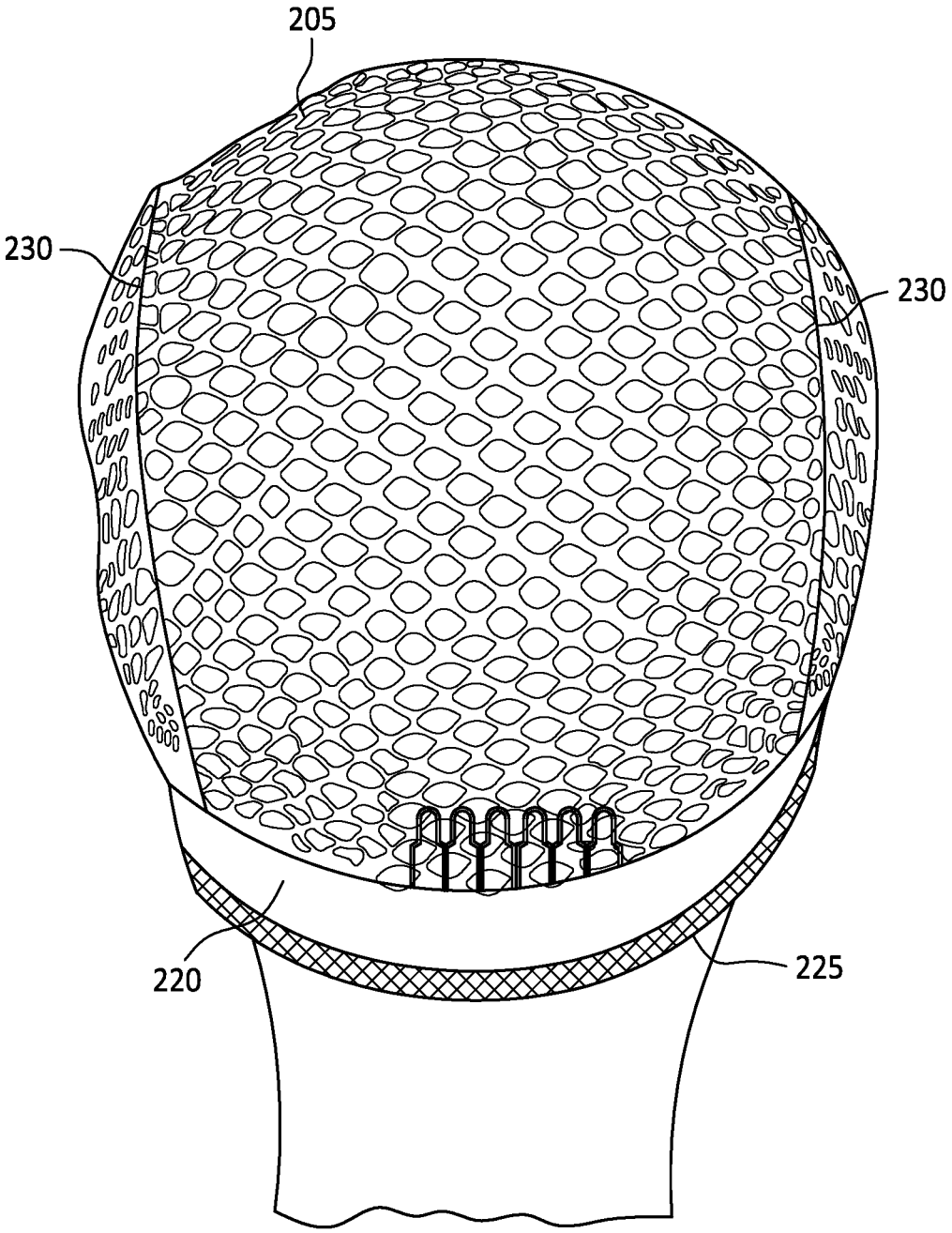

FIG. 5 illustrates a rear view of the wig apparatus 200. In FIG. 5, the wig apparatus 200 is illustrated in an inside-out configuration for the purpose of showing the internal features thereof. The comb 225 is attached to the interior surface of the mesh base 205. As illustrated in FIGS. 4 and 5, the combs 225 are disposed on the band member 215 in areas corresponding to the user's left and right temple as well as the nape of the user's neck. The comb 225 includes tines that are inserted into the user's hair to further secure the wig apparatus 200 to the user's head, preventing slipping and shifting of the wig apparatus 200 when the wig apparatus 200 is worn by the user.

The mesh base 205 includes multiple seams 230. Separate sections of the mesh base 205 are stitched together at the seams 230. As shown in FIGS. 4 and 5, the mesh base 205 includes three separate sections of material sewn together along two seams 230. In certain embodiments, the mesh base 205 is one section of material with no seams, two sections of material with one seam, four sections of material with three seams, etc.

Embodiments of the invention described herein provide a wig apparatus that includes a mesh base and a hair coupling region. As described herein, the mesh base holds the hair coupling region flat and prevents the hair coupling region from wrinkling when the wig apparatus is worn by the user. The wig apparatus provides the user with a useful and convenient product for partially covering their natural hair with artificial hair.

Further embodiments of the invention described herein also provide a wig apparatus that includes a mesh base and a hair parting region. In this embodiment, the user is able to customize the location, density, style and color of the wefts of artificial hair on the wig apparatus. The mesh base wraps around a band member of the wig apparatus such that wefts of artificial hair can be coupled to the perimeter edge of the wig apparatus as well as the interior portion and exterior portion of the band member providing a natural and desirable appearance.

While embodiments of the invention have been shown and described with reference to certain embodiments thereof, it will be understood by those skilled in the art that various changes in form and details may be made therein without departing from the spirit and scope of the invention and equivalents thereof.

What is claimed is:

1. A wig apparatus comprising:

a mesh base comprising an inner surface, an outer surface, a fold portion and a terminal edge portion;

a band member comprising a first surface, a second surface, a top edge and a bottom edge, wherein the first surface of the band member is coupled to the inner surface of the mesh base and wherein the second surface of the band member is coupled to the inner surface of the mesh base;

a first portion of artificial hair coupled to at least the outer surface of the mesh base adjacent to the first surface;

a second portion of artificial hair coupled to the outer surface of the mesh base adjacent to the second surface; and a strip member coupled to the second surface of the band member, wherein the first surface of the band member faces a direction opposite to the second surface of the band member, and wherein the mesh base extends across an entire surface of the first surface of the band member and the mesh base extends across an entire surface of the second surface of the band member.

2. The wig apparatus according to claim 1, wherein at least a portion of the first portion of artificial hair is coupled to the outer surface of the mesh base at a position substantially equidistant to the fold portion as at least a portion of the second portion of artificial hair is coupled to the outer surface of the mesh base.

3. The wig apparatus according to claim 1, wherein the bottom edge is disposed adjacent to the fold portion.

4. The wig apparatus according to claim 1, wherein the top edge is disposed adjacent to the terminal edge portion.

5. The wig apparatus according to claim 1, wherein at least a portion of the strip member is disposed between the second surface of the band member and the inner surface of the mesh base.

6. The wig apparatus according to claim 1, wherein at least a portion of the mesh base is disposed between the strip member and the second surface of the band member.

7. The wig apparatus according to claim 1, wherein the terminal edge portion is disposed between the second surface of the band member and the strip member.

8. The wig apparatus according to claim 1, wherein the strip member does not extend across an entire surface of the second surface.

9. A wig apparatus comprising:

a mesh base comprising an inner surface, an outer surface, a fold portion and a terminal edge portion;

a band member comprising a first band end, a second band end, a first surface, a second surface, a top edge and a bottom edge, wherein the first surface of the band member is coupled to the inner surface of the mesh base and wherein the second surface of the band member is coupled to the inner surface of the mesh base;

a first portion of artificial hair coupled to at least the outer surface of the mesh base adjacent to the first surface;

a second portion of artificial hair coupled to the outer surface of the mesh base adjacent to the second surface;

a hair parting region extending from the fold portion to substantially a center of the mesh base; and a strip member comprising a first strip end and a second strip end, wherein the strip member is coupled to the second surface of the band member, and wherein the first strip end is coupled to the first band end and the second strip end is coupled to the second band end, wherein the first surface of the band member faces a direction opposite to the second surface of the band member, and wherein the mesh base extends across an entire surface of the first surface of the band member and the mesh base extends across an entire surface of the second surface of the band member.

10. The wig apparatus according to claim 9, wherein the band member does not extend around an entire circumference of the wig apparatus and wherein the strip member does not extend around an entire circumference of the wig apparatus.

11. The wig apparatus according to claim 9, wherein the hair parting region is at least partially disposed between the first strip end and the second strip end.

12. The wig apparatus according to claim 9, wherein at least a portion of the first portion of artificial hair is coupled to the outer surface of the mesh base at a position substantially equidistant to the fold portion as at least a portion of the second portion of artificial hair is coupled to the outer surface of the mesh base.

13. A wig apparatus comprising:

a mesh base comprising a fold portion, a terminal edge portion, an inner surface that faces towards a user's head when the wig apparatus is worn except a portion of the mesh base that extends from the fold portion to the terminal edge portion, which faces in an opposite direction, and an outer surface that faces away from the user's head when the wig apparatus is worn;

a band member comprising a first surface, a second surface, a top edge and a bottom edge, wherein the first surface of the band member is coupled to the inner surface of the mesh base and wherein the second surface of the band member is coupled to the inner surface of the mesh base;

a first portion of artificial hair coupled to at least the outer surface of the mesh base adjacent to the first surface;

a second portion of artificial hair coupled to the outer surface of the mesh base adjacent to the second surface; and wherein the first surface of the band member faces a direction opposite to the second surface of the band member, and wherein the mesh base extends across an entire surface of the first surface and at least a portion of the second surface of the band member with a least a portion of the second surface of the band member not in contact with the mesh base.

* * * * *